US005382350A

United States Patent [19]

Schmidt

[11] Patent Number: 5,382,350

[45] Date of Patent: Jan. 17, 1995

[54] HIGH HYDROGEN AND LOW COKE REFORMING PROCESS

[75] Inventor: Robert J. Schmidt, Barrington, Ill.

[73] Assignee: UOP, Des Plaines, Ill.

[21] Appl. No.: 961,963

[22] Filed: Oct. 16, 1992

[51] Int. Cl.[6] ..... C10G 35/06

[52] U.S. Cl. ..... 208/65; 208/139

[58] Field of Search ..... 208/65, 63

[56] References Cited

U.S. PATENT DOCUMENTS

| | | | |
|---|---|---|---|
| 2,892,858 | 6/1959 | Ziegler | 260/448 |
| 4,119,526 | 10/1978 | Peters et al. | 208/64 |
| 4,124,490 | 11/1978 | Collins et al. | 208/139 |
| 4,208,397 | 6/1980 | Coates | 208/65 |
| 4,212,726 | 7/1980 | Mayes | 208/65 |
| 4,409,095 | 10/1983 | Peters | 208/134 |
| 4,440,626 | 4/1984 | Winter et al. | 208/65 |
| 4,636,298 | 1/1987 | Buss et al. | 208/65 |
| 4,645,586 | 2/1987 | Buss | 208/65 |
| 4,677,094 | 6/1987 | Moser et al. | 502/227 |
| 4,714,538 | 12/1987 | Moser et al. | 208/139 |
| 5,108,582 | 4/1992 | Foutsitzis et al. | 208/138 |
| 5,135,639 | 8/1992 | Schmidt et al. | 208/66 |

*Primary Examiner*—Dale R. Ore

*Attorney, Agent, or Firm*—Thomas K. McBride; John G. Tolomei

[57] ABSTRACT

A low severity continuous reforming process that operates at conditions to provide a low coke production provides an improved reformulated gasoline fuel. The conditions for the reforming operation include high space velocity, relatively high temperature and low hydrogen to hydrocarbon ratios. Despite the higher temperature, the process provides stable coke production rates at a very low level while providing relative high hydrogen yields. The lower severity operation and the high hydrogen yield facilitate the removal of benzene from the reformulated gasoline pool while avoiding the anticipated hydrogen deficit that such operations would produce.

8 Claims, 1 Drawing Sheet

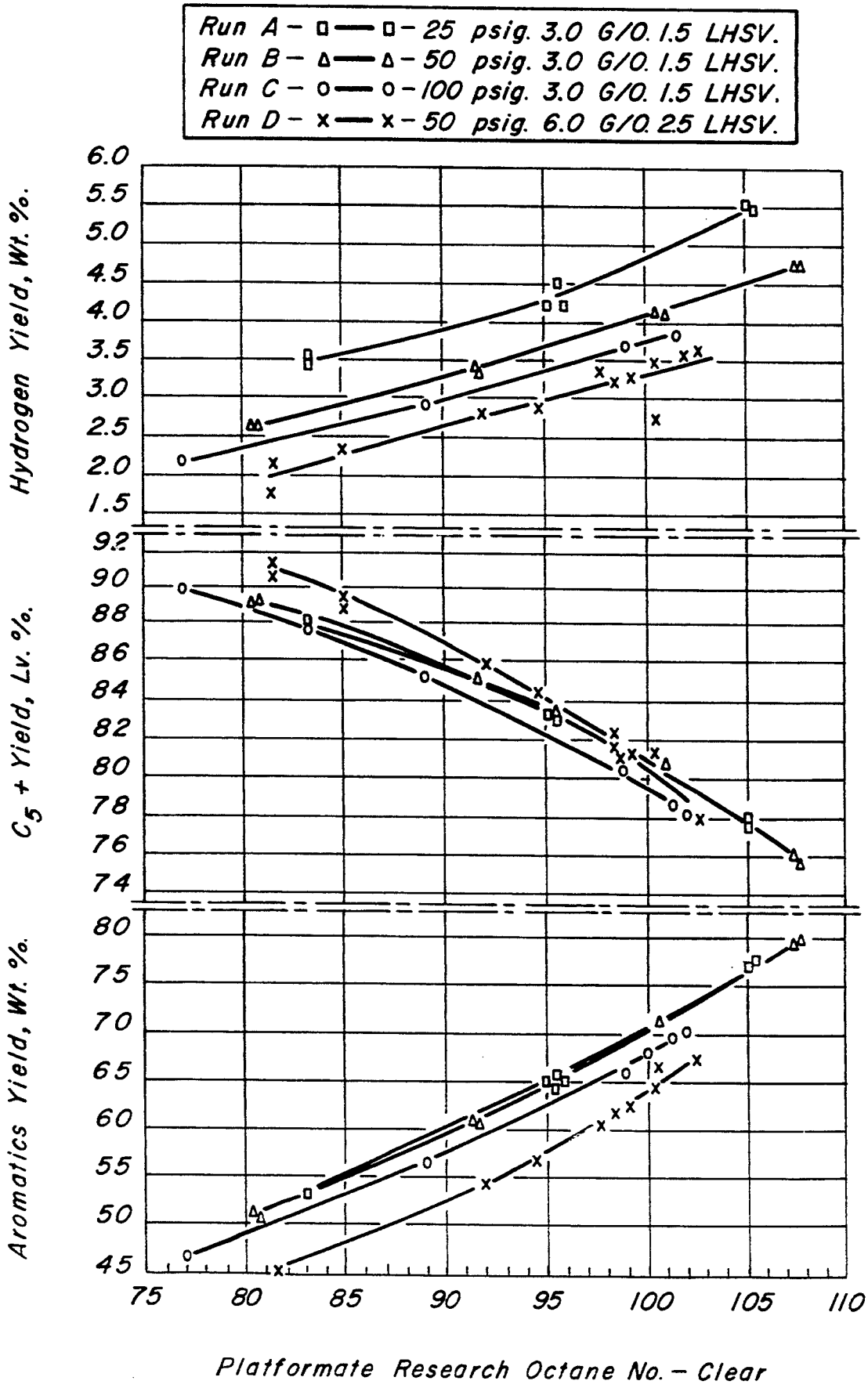
Run A – □—□ – 25 psig. 3.0 G/O. 1.5 LHSV.
Run B – Δ—Δ – 50 psig. 3.0 G/O. 1.5 LHSV.
Run C – o—o – 100 psig. 3.0 G/O. 1.5 LHSV.
Run D – x—x – 50 psig. 6.0 G/O. 2.5 LHSV.
Hydrogen Yield, Wt. %.
$C_5$ + Yield, Lv. %.
Aromatics Yield, Wt. %.
Platformate Research Octane No. – Clear

HIGH HYDROGEN AND LOW COKE REFORMING PROCESS

FIELD OF THE INVENTION

This invention relates generally to the reforming of hydrocarbons. More specifically this invention relates to the production of hydrogen from a reforming process.

BACKGROUND OF THE INVENTION

Catalytic reforming processes have long served as a primary means of upgrading hydrocarbon streams to increase the octane of gasoline products.

Generally the hydrocarbon feedstock comprises a petroleum gasoline fraction commonly referred to as naphtha. The naphtha stream usually comprises relatively large concentrations of naphthenic and substantially straight, chain paraffinic hydrocarbons. The reforming process performs a variety of concomitant reactions which consists principally of naphthene isomerization, dehydrogenation of naphthenes to aromatics, dealkylation and demethylation of aromatics to lighter aromatics, isomerization of normal paraffins to isoparaffins, and hydrocracking. Reforming is a catalytic process that relies on a substantial number of acid and metal sites on the catalyst. A typical reforming process mixes hydrogen with the hydrocarbon feedstock before entering a first reaction zone. The feed passes serially through at least one additional reaction zone before separation to provide a vapor phase comprising hydrogen for recycle of the feedstock and a liquid product phase providing the gasoline composition. Since the various reactions that take place are highly endothermic, the process takes place in a series of reaction zones with intermediate reheating between the reaction zones to maintain reaction temperatures. It has been taught that the reforming process can operate at a wide variety of conditions including temperatures in a range of from 800°-1100° F., pressures of from 0 to 1000 psig, liquid hourly space velocities (LHSV) of from 0.1 to 10, and hydrogen to hydrocarbon ratios of from 0.5 to 20.

Most reforming processes are designed to operate in either a continuous manner with a continuous catalyst regeneration section, or in what is generally referred to as a semi-regenerative operation. Reforming operations started out with a semi-regenerative process in which feed to a reactor or reactors is periodically stopped and the catalyst within that reaction zone is regenerated by steps of coke oxidation, halogenation, and reduction. Continuous catalyst regeneration is well known in the art and is used to continuously or intermittently remove small amounts of catalyst from an operating series of reforming reactors without stopping the feed to the series of reaction zones and returning the catalyst to the series of reaction zones after regeneration. Continuous catalyst regeneration operations have generally been favored in the past to permit the operation of the reformer at high severity and thereby maximize octane production. Where a reforming process operates at low severity, there is a disincentive to the use of a continuous catalyst regeneration system due to its added cost.

Historically, reformers have operated on naphtha-rich feeds to produce aromatics and in particular benzene with the additional benefit of producing large amounts of hydrogen through dehydrogenation reactions. In the past, a typical gasoline fraction for upgrading in a reforming process had initial boiling points of from 150°-200° F. and end boiling points of from 325°-425° F. New requirements for reformulated gasoline have profound impacts on the operation of reformers. Reformulated gasoline requirements impose limitations on gasoline end points, benzene as well as total aromatics, and reid vapor pressure (RVP). Benzene reduction poses one of the most severe problems for the operation of the reformer for benzene precursors must be removed prior to a reforming operation or removed from the product stream by either direct saturation or saturation through isomerization. In some cases benzene can be reduced by alkylation to cumene. The most advantageous way to eliminate benzene is by minimizing its production within the reformer. Benzene and benzene precursors may be removed prior to reforming or benzene may be treated after the reforming operation by saturation directly or through isomerization, alkylation to cumene or other higher aromatics or finally by direct extraction to recover benzene products where refiners are equipped to provide petrochemical benzene. Limitations on the amount of aromatics arise indirectly due to limitations on benzene and the function of aromatics as benzene precursors. Therefore, along with benzene reduction, reduction in aromatics will also follow from the revised role of reforming under the requirements of reformulated gasoline. Other effects of reformulated gasoline requirements such as limitations on end points and RVP will have less direct impact on the operation of the reforming zone but will nevertheless impact the operation severity of reforming units. However, requirements for oxygen containing compounds in the gasoline pool will increase gasoline octane via the addition of alcohols and ethers such as MTBE. These relatively high octane blending components reduce the overall octane requirement of the reformer thereby further altering operations. Thus, reformulated gasoline will have the effect of lowering octane requirements along with hydrogen production from the reformer.

Unfortunately, the lower production of hydrogen comes together with increased demands for hydrogen in most refineries. For example, reformulated gasoline will also emphasize the need to remove sulfur from feedstocks often through hydrodesulfurization. Increased hydrogen demands further arise from the hydrocracking of heavy naphtha components which come available from the decrease in the ASTM 90% distillation point (T-90) and the additional needs of sulfur removal. The necessity for direct saturation of benzene will require additional amounts of hydrogen. There will also be increased emphasis on isomerization and alkylation to provide lower RVP components to the gasoline pool which, with the concomitant side reactions, also consume more hydrogen.

External sources of hydrogen are available such as hydrogen plants, or other technologies for supplying hydrogen, however these methods are not favored due to their relatively high cost. Thus, there is a need for processing reforming feeds that will accommodate the requirements for reformulated gasoline. Such a method needs to provide high hydrogen production at low octane severity with a low production of benzene. An additional requirement is that such process operate without an increase in RVP.

BRIEF DESCRIPTION OF THE INVENTION

It has been surprisingly found that a reforming process can operate at low severity conditions and at low coke production conditions to produce a high hydrogen product. The production of low coke and high hydrogen has been found to occur at high space velocity and high temperature conditions. Unexpectedly, the higher temperature operating conditions did not lead to higher rates of coke formation. In addition, the $C_5$ and heavier portion of the product stream possessed a reduced RVP relative to typical reforming products. Thus, the operation of the reformer at high temperature, high space velocity, and low pressure conditions provides a reforming product stream more suitable for use in reformulated fuels together with the high hydrogen yield necessary to meet other processing demands for the supply of reformulated fuels.

Accordingly in one embodiment, this invention is a reforming process for contacting a feed containing hydrocarbons with a reforming catalyst. The process comprises heating the feed to a temperature in a range of from 950°-1050° F. and contacting the feed with a reforming catalyst in a first reforming reaction zone at a pressure in a range of from 25 to 150 psig and LHSV of from 2 to 10 and an initial molar hydrogen to hydrocarbon ratio of less than 2 to at least partially convert the feed and produce hydrogen. The at least partially converted feed is recovered from the first reforming zone in an intermediate feedstream, and the intermediate feedstream is contacted in at least one additional reforming reaction zone with a reforming catalyst at conditions to limit the production of coke in the first reforming reaction zone and the at least one additional reforming reaction zone to less than 1.5 wt. % coke on the catalyst per 1000 standard cubic feet per barrel (SCFB) of hydrogen produced. The conditions in the additional reforming reaction zone include a temperature, pressure, space velocity and hydrogen to hydrocarbon ratio within the same range of those specified for the first reaction zone. A product stream comprising converted feed hydrocarbons and hydrogen is recovered from the last of the at least one additional reforming reaction zones. Coke containing reforming catalyst is at least semi-continuously withdrawn from the reforming reaction zones and regenerated catalyst, having a reduced concentration of coke relative to the withdrawn reforming catalyst, is added to the reforming reactions zones while contacting the feed with the reforming catalyst.

DETAILED DESCRIPTION OF THE INVENTION

The invention can be practiced using most feeds that are suitable reforming operations. Such feeds include full boiling range naphthas having distillation end points of from 320°-400° F. Feeds of this type can comprise straight-run naphthas or mixtures of naphtha, coke or gas oils, FCC condensates and other broad range blends of feedstocks. In most cases, it will be advantageous to prefractionate benzene precursors from the feedstock. Typically, this will give the feedstock an initial boiling point in the range of 210°-230° F. A boiling point set for the prefractionation of benzene retains toluene and higher boiling hydrocarbons in the naphtha feedstock for the reforming operation. In many cases it is also advantageous to curtail the end boiling point in order to reduce the amount of heavy aromatics and to control the T-90 distillation point of the reformate product for the gasoline blending pool. Therefore, the preferred feedstock is a straight-run naphtha having end boiling point temperatures of from 220°-350° F.

The feed will be admixed with a hydrogen-containing stream in a relatively low hydrogen to hydrocarbon ratio. The low hydrogen to hydrocarbon ratios are particularly useful in maximizing the production of hydrogen from the process. The invention uses a hydrogen to hydrocarbon ratio of less than 2. In particularly preferred aspects of this invention, the hydrogen to hydrocarbon ratio will be in the range of 0.2 to 1.0.

Operating conditions for the reforming process of this invention are generally characterized as low severity. The term "severity" when used in reference to reforming operations can refer to the processing conditions as well as the product octane. Thus, reforming operations, if they produce high octanes in a range of from 95 RON or greater are generally referred to as high severity, whereas operations producing lower octane are often referred to as low severity. This invention is generally characterized as low severity in that it produces a relatively low octane product compared to the operation of many reforming units with continuous catalyst regeneration. The operating conditions of this invention are unique in that they use a combination of what is generally referred to as low severity and high severity operating conditions. The inlet temperatures for the catalyst bed are in a higher range of normal operating conditions such that these are generally characterized as high severity reforming conditions. Operating temperatures for the reaction zones are typically in a range of from 950°-1050° F. Conversely, the reaction zones operate at a space velocity normally associated with low severity conditions. The reaction zones will operate with a space velocity of at least 2 and more often a space velocity of 5 or more. An important operating parameter of the invention is a pressure which will be in a range of from 0 to 150 psig, and usually in a range of from 50 to 100 psig. A combination of low pressure, high space velocity and relatively high temperature provide the necessary conditions for the high hydrogen yield in combination with the low coke production.

The total coke production from the operation of the reaction zone is limited by the combination of reaction conditions that produce a low severity operation. These low severity conditions include operation of the reaction zone to produce a product usually in a research octane number range of from 86 to 94. At the relatively high temperature and space velocity conditions with a relatively low hydrogen to hydrocarbon ratio and pressure, coke production can be limited to less than 1.5 wt. % per 1000 SCFB of hydrogen produced. Together the process is operated with these conditions at a low coke production mode that produces coke at a rate of less than 1.5 wt. % on the catalyst per 1000 SCFB of hydrogen produced in the reaction zones.

The effluent from the last reaction zone provides a hydrogen-rich vapor phase. Separation of the hydrogen-rich vapor phase into a principal liquid hydrocarbon phase and a relatively pure hydrogen stream provides a hydrogen recycle stream. After compression, the hydrogen stream is returned to the reaction zone to supply the necessary hydrogen. The invention uses low hydrogen partial pressures to maintain high hydrogen production from the reaction zones. Part of the surprising results of this invention are the relatively low and stable coke production that results from the operation of the reaction zones despite low hydrogen partial pressures.

The combination of these operating conditions in the low coke production mode provide the beneficial reaction regime within the reforming reaction zone. Low pressure in the reforming reaction zone and high temperature in the reforming reaction zone favor dehydrocyclization of heavier paraffins to naphthenic hydrocarbons. Due to the high space velocity, conversion of lower molecular weight paraffins to naphthenic hydrocarbons is inhibited such that precursors for heavier aromatics are principally present in the reforming reaction zone. The low pressure conditions are also favorable in inhibiting undesirable reactions such as hydrocracking, demethylation and dealkylation which would otherwise consume hydrogen and reduce the hydrogen yield from the reforming operation. The low coke condition of the catalyst is believed to be responsible for maintaining naphthene isomerization for the conversion of cyclopentane to cyclohexane and thereby providing additional precursors for heavy aromatics. The low pressure conditions also inhibit hydrogenation reactions such that the dehydrogenation of the naphthenic hydrocarbons is not equilibrium limited so that the dehydrogenation can proceed to theoretical completion.

Finally, the reforming operation of this invention also provides a low RVP that substantially reduces the contribution of reformate RVP to the overall gasoline pool. Low operating pressure very selectively converts higher molecular weight paraffins to aromatics. Relative to a higher pressure operation, this very selective conversion reduces the need to convert as much heavy paraffin material to achieve a given octane level. Also, the formation of lighter paraffin byproducts such as pentanes, which have a high RVP, are greatly reduced at low pressure. Thus, the combination of reduced light $C_5$ paraffin formation (high RVP material) and increased heavy paraffin concentration (low RVP material) achieved with this low pressure operation, significantly reduces the $C_5$+ product RVP.

The reaction zones of this invention are arranged to provide a high space velocity. The LHSV for the reaction zone of this invention will range from about 2 to 10 with LHSV's of 5 or more being preferred. Although there is no limit to the number of reaction zones that can be used in this invention, the high space velocity associated with this process will require less reaction zones than a conventional reforming operation. In most cases, an arrangement of two reaction zones in series is preferred.

This invention may be practiced as a new reforming unit or as a revamp application. This invention is particularly applicable to revamp applications of semi-regenerative reforming operations. In such applications, two of the existing reforming reactors may be converted to continuous catalyst regeneration application by the addition of a continuous catalyst regeneration system. Also, reuse of the existing heater system (generally 3 or 4 heaters) has been found to be feasible in most cases which greatly reduces required capital investment. The remaining reactors may be utilized in isomerization, alkylation or other processes for upgrading other components of the naphtha feedstock.

Although the operating conditions for the reaction zones of this invention generate coke at a much lower rate than the prior art reforming operations, practical operation of the invention will require continuous circulation of catalyst through the reactors to maintain reaction zone activity. Due to the low hydrogen partial pressure of this process, the reaction zones will have continuous catalyst circulation. Although the catalyst circulation is referred as continuous, a typical continuous process will periodically withdraw a small amount of catalyst from the reaction zones while adding catalyst to the reaction zones that have a reduced amount of coke deactivation relative to the catalyst withdrawn. In order to provide continuous circulation of catalyst through the reaction zones, a continuous catalyst regeneration section will be present to regenerate catalyst from the reaction zones. The operation and design of reaction sections using continuous catalyst regeneration are well known. The reactors of this invention can have a stacked or side-by-side configuration. In the preferred embodiment that uses two reaction zones, the catalyst bed in the first reaction zone will contain between 20–40% of the total catalyst and the reaction zone provided by the second catalyst bed will provide the remainder of the catalyst.

A wide variety of catalyst compositions can be used to practice this invention. These catalysts generally comprise dual function reforming catalysts containing a metallic hydrogenation-dehydrogenation component on a refractory support which provides acid sites for cracking and isomerization. The refractory support of the first reforming catalyst should be a porous, adsorptive, high-surface-area material which is uniform in composition without composition gradients of the species inherent to its composition. Within the scope of the present invention are refractory supports containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; and (5) combinations of materials from one or more of these groups. The preferred refractory support for the first reforming catalyst is alumina, with gamma- or eta-alumina being particularly preferred. Best results are obtained with "Ziegler alumina," described in U.S. Pat. No. 2,892,858 and presently available from the Vista Chemical Company under the trademark "Catapal" or from Condea Chemie GmbH under the trademark "Pural," Ziegler alumina is an extremely high-purity pseudoboehmite which, after calcination at a high temperature, has been shown to yield a high-priority gamma-alumina. It is especially preferred that the refractory inorganic oxide comprise substantially pure Ziegler alumina having an apparent bulk density of about 0.6 to 1 g/cc and a surface area of about 150 to 280 $m^2/g$ (especially 185 to 235 $m^2/g$) at a pore volume of 0.3 to 0.8 cc/g. Methods of forming the alumina powder are further described in U.S. Pat. No. 5,135,639.

An essential component of such reforming catalysts is one or more platinum-group metals, with a platinum component being preferred. The platinum may exist within the catalyst as a compound such as the oxide, sulfide, halide, or oxyhalide, in chemical combination with one or more other ingredients of the catalytic composite, or as an elemental metal. Best results are obtained when substantially all of the platinum exists in the catalytic composite in a reduced state. The platinum component generally comprises from about 0.01 to 2 mass % of the catalytic composite, preferably 0.05 to 1 mass %., calculated on an elemental basis. It is within the scope of the present invention to modify the effect of the preferred platinum component. Such metal modifiers may include Group IVA (14) metals, other Group VIII (8–10) metals, rhenium, indium, gallium, zinc, uranium, dysprosium, thallium and mixtures thereof. Excellent results are obtained when the first reforming catalyst contains a tin component. Catalytically effective mounts of such metal modifiers may be incorporated into the catalyst by any means known in the art.

Reforming catalysts often contain a halogen component. The halogen component may be either fluorine, chlorine, bromine or iodine or mixtures thereof. Chlorine is the preferred halogen component. The halogen component is generally present in a combined state with the inorganic-oxide support. The halogen component is preferably well dispersed throughout the catalyst and may comprise from more than 0.2 to about 15 wt. %, calculated on an elemental basis, of the final catalyst.

The reforming catalyst generally will be dried at a temperature of from about 100°–320° C. for about 0.5 to 24 hours, followed by oxidation at a temperature of about 300°–550° C., in an air atmosphere for 0.5 to 10 hours. Preferably, the oxidized catalyst is subjected to a substantially water-free reduction step at a temperature of about 300°–550° C. for 0.5 to 10 hours or more. Further details of the preparation and activation of embodiments of the first reforming catalyst are disclosed in U.S. Pat. No. 4,677,094 (Moser et al.), which is incorporated into this specification by reference thereto.

Particularly advantageous results for this invention have been obtained with a reforming catalyst composition comprising 0.375 wt. % Pt contained on a support that has been formed from a sol containing 0.3 wt. % Sn and oil-dropped to form 1/16" spheres. Preferably, the chloride content of such catalysts is adjusted to a level of 1.0 to 1.1 wt. % on the support.

It has been found that a light paraffin conversion (LPC) type catalyst is particularly beneficial for this invention. The preferred LPC catalyst contains a non-acidic L-zeolite and a platinum-group metal component. Such catalysts are highly sulfur sensitive. Feeds that contact the catalyst will preferably have sulfur levels of 1 to 0.1 ppm or less.

It is preferred that the L-zeolite be non-acidic, as acidity in the zeolite lowers the selectivity to aromatics of the finished catalyst. In order to be "nonacidic," the zeolite has substantially all of its cationic exchange sites occupied by non-hydrogen species. More preferably, the cations occupying the exchangeable cation sites will comprise one or more of the alkali metals, although other cationic species may be present. An especially preferred non-acidic L-zeolite is potassium-form L-zeolite.

It is necessary to composite the L-zeolite with a binder in order to provide a convenient form for use in the catalyst of the present invention. The art teaches that any refractory inorganic oxide binder is suitable. One or more of silica, alumina or magnesia are preferred binder materials of the LPC catalyst. Amorphous silica is especially preferred, and excellent results are obtained when using a synthetic white silica powder precipitated as ultra-fine spherical particles from a water solution. The silica binder preferably is non-acidic, contains less than 0.3 mass % sulfate salts, and has a BET surface are of from about 120 to 160 $m^2/g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcinations. The resulting dough is extruded through a suitably shaped and sized die to form extrudate particles, which are dried and calcined by known methods. Alternatively, spherical particles may be formed by methods described hereinabove.

A platinum-group metal component is an essential feature of the LPC catalyst, with a platinum component being preferred. The platinum may exist within the catalyst as any of the compounds previously described for reforming catalysts. Further details of the LPC catalyst are disclosed in U.S. Pat. No. 5,108,582, which is incorporated into this specification by reference thereto.

The conversion of a feedstock using an LPC catalyst and a traditional reforming catalyst were compared. The feedstock comprised a lean BTX naphtha with an API gravity of 62.8, an ASTM distillation of 166° F. (IBP)/212° F. (50% point)/278° F. (EP) and composition of 62 (vol.) % paraffins/28.5% naphthenes/9.5% aromatics. The feedstock was contacted with the LPC catalyst at a variety of pressure conditions and a hydrogen to hydrocarbon ratio of 3 and an LHSV of 1.5. The results of this contacting is shown graphically in FIGURE 1. As a comparison, an additional test was run with the traditional reforming catalyst which comprised a platinum on alumina having a platinum concentration of between 0.29 to 0.375. An apparent bulk density of 0.58 g/cc, a chloride concentration of 1.0 to 1.2 and a tin modifier. The feedstock was contacted with the traditional reforming catalyst at a pressure of 50 psig, hydrogen to hydrocarbon ratio of 6 and an LHSV of 2.5.

BRIEF DESCRIPTION OF THE DRAWING

The results of the test are shown as Run D in FIGURE 1. The FIGURE demonstrates that as pressure decreased from Run C through Runs A, the hydrogen yields significantly increased with the LPC catalyst while $C_5+$ liquid yields remained relatively stable and aromatics yields increased only slightly. By way of comparison, Run D using the traditional reforming catalyst had the lowest hydrogen yield while providing similar $C_5+$ liquid volume yields with an only somewhat reduced aromatics yield. Accordingly, the LPC type catalyst is particularly preferred for the practice of this invention.

EXAMPLE 1

The process of this invention was simulated using a fixed bed reactor to show the stable coke production of the process of this invention and the conversion of a naphtha feed cut. The feedstock comprised a naphtha which was prefractionated to remove benzene and benzene precursors. The naphtha feed cut has the properties given in Table 1 and was passed into contact with a catalyst having an apparent bulk density (ABD) of about 0.58, a platinum content of from 0.29 to 0.375 wt.

% and a halogen content of 1.0 to 1.1 wt. % chlorine. The catalyst also included the presence of a tin activator. In order to simulate a typical high severity reforming operation on the subject feed, the process was operated with the feed passing through four reactors at a weighted average initial temperature (WAIT) of 946° F. and a weight average bed temperature (WABT) of 902° F. The feeds pass through the reactors at a LHSV of 1.5 and enters the reactors at initial hydrogen to hydrocarbon molar ratio of 2. The reactors are maintained at a pressure of 50 psig. This relatively high severity operation produced the products listed in Table 2. Table 2 shows that the relatively high severity operation produced a high octane product with a substantial amount of hydrogen and high percentage yield of coke. Based on the spent catalyst analysis the percentage of coke produced by the production of reformate was typical of reforming processes.

TABLE 1

| | |
|---|---|
| API | 57.3 |
| ASTM DIST °F. | |
| I.B. | 221 |
| 50% | 269 |
| E.P. | 345 |
| Liquid Vol. % | |
| Paraffins | 61.3 |
| Naphthenes | 25.0 |
| Aromatics | 13.7 |

EXAMPLE 2

In accordance with this invention, another test run was performed on the feedstock listed in Table 1. The operation simulated this invention by passing the feed through 2 reactors containing catalyst the same as that used in Example 1. The feed passes through the reactors at a WAIT of 1002°, a WABT of 920° F. and an LHSV of 5.0 and at the same hydrogen to hydrocarbon ratios and pressures as Example 1. The higher space velocity and higher temperature process produced the products listed in Table 2. The mixture of high severity temperature and low severity space velocity produced a product having lower octane than that produced in Example 1. However, in Example 2, a higher liquid volume yield of $C_5+$ hydrocarbons was obtained with a relatively high hydrogen yield which was close to that produced in the high severity operation of Example 1. More surprisingly, Example 2 produced very small percentage amounts of coke. Another advantage of this invention is the low RVP for the reformate product. Therefore, Example 2 demonstrates that the operation of this invention will maintain a high yield of hydrogen despite a low octane product and relatively low severity space velocity conditions. Again, based on spent catalyst analysis the percentage of coke produced was very low as compared to coke production in Example 1. Therefore, it has also been established that the reforming operation of this invention will operate with stable coke production.

TABLE 2

| Example | 1 | 2 | 3 |
|---|---|---|---|
| RONC | 98 | 92 | 98 |
| $C_5+$ Yield, LV-% | 84.7 | 86.8 | 75.4 |
| $H_2$ Yield, SCFB | 1614 | 1388 | 901 |
| % Coke/BPP | 4.5 | 1.7 | 0.5 |
| % Coke/1000 SCFB $H_2$ | 2.8 | 1.2 | 0.6 |
| $C_5+$ RVP | 2.58 | 2.54 | 4.29 |

EXAMPLE 3

The feed in Table 1 was treated in accordance with the operating conditions typical of that of a semi-regenerative reforming operation, namely an LHSV of 1.5, an $H_2$/HC molar ratio of 4.0 and a pressure of 300 psig. Also, the simulation of Example 3 was based on a catalyst containing 0.2 to 0.4% Pt and 0.4 to 0.8% Re supported on a 0.65 to 0.8 g/cc ABD alumina support in either an extruded or oil-dropped spherical form. The chloride content of the catalyst has been adjusted to a level of 1.0 to 1.2 wt. % of support. At the higher pressure conditions, the reforming operation of this example produced a $C_5+$ product having an RVP of 4.29. Accordingly, the low pressure conditions of this invention, which permit stable operation from a coke production standpoint, also facilitate the lowering of reid vapor pressure relative to the operation of reformers at higher pressure.

EXAMPLES 4–6

In order to further compare the operation of this invention with a typical semi-regenerative reforming operation, two simulations based on operating data from typical reforming operations were performed. Examples 5–6 were based on the treatment of the feed described in Table 3. The simulation of Examples 4–6 are based on the catalyst of Example 3. The simulation of Example 5 is based on the same catalyst as used in Example 1.

In Example 4 the feed passes through two beds of catalyst at a LHSV of 3.5 and a WAIT of 948° F. In view of the semi-regenerative operation, the process operates at a higher pressure of 300 psig and a hydrogen to hydrocarbon mole ratio of 3.0. A typical semi-regenerative operation of this type will operate for approximately 12 to 13 months between regenerations. The operation produced a reforming effluent having the properties listed in Table 4.

TABLE 3

| | |
|---|---|
| API | 60.5 |
| ASTM DIST. °F. | |
| I.B.P. | 206 |
| 50% | 246 |
| E.P. | 330 |
| Liquid Vol. % | |
| Paraffins | 69.1 |
| Naphthenes | 19.9 |
| Aromatics | 11.0 |

The operation of Example 5 treats the feed described in Table 3 at a WAIT of 1000° F., a pressure of 50 psig, a LHSV of 5.0 and a hydrogen to hydrocarbon ratio of 0.2. The feed passes through 2 reactors and produces the effluent described in Table 4. A comparison of Examples 4 and 5 shows that with both operations producing an 85 research octane number product, the continuous regeneration operation produces a higher $C_5+$ yield with a greatly improved hydrogen yield. Accordingly, the low severity CCR operation provides a significant advantage in meeting hydrogen requirements over the semi-regenerative operation.

TABLE 4

| Example No. | 4 | 5 | 6 |
|---|---|---|---|
| RONC | 85 | 85 | 98 |
| $C_5+$ Yield, LV-% | 87.1 | 91.1 | 75.4 |
| Arom. Conc., LV-% | 41 | 43 | 59 |

TABLE 4-continued

| Example No. | 4 | 5 | 6 |
|---|---|---|---|
| $H_2$ Yield, SCFB | 666 | 1089 | 901 |

Example 6 sets forth the operation of a high severity semi-regenerative operation. The same feedstock as used in Examples 4 and 5 contacts 4 beds of catalyst at a WAIT of 945°, a pressure of 300 psig, and a LHSV of 1.3. The hydrogen to hydrocarbon molar ratio is maintained at 4 and the operation provides a product having the properties set forth in Table 4. A comparison of Examples 5 and 6 shows that the much higher octane product obtained from the high severity operation reduces the $C_5$+ yield and increases the aromatic concentration of the liquid product. Apart from the increased octane, the $C_5$+ decrease and the aromatic concentration increase both provide a less acceptable reformulated gasoline fuel. Moreover, the hydrogen yield from the high severity operation is still less than the low severity CCR operation.

I claim:

1. A reforming process for contacting a feed, containing hydrocarbons, with a reforming catalyst said process comprising:

a) heating said feed to a temperature in a range of from 950°-1050° F. and contacting said feed with a reforming catalyst comprising at least one of a non-acidic L-zeolite with a platinum group metal component on a refractory inorganic oxide binder and a platinum component and a tin component on a refractory support in a first reforming reaction zone at a pressure in a range of from 25 to 150 psig, an LHSV of from 2 to 10 and an initial molar $H_2$/HC ratio of less than 2 to at least partially convert said feed and produce hydrogen;

b) recovering at least partially converted feed and hydrogen from said first reforming zone in an intermediate feed stream and contacting said intermediate feed stream in at least one additional reforming reaction zone with a reforming catalyst comprising at least one of a non-acidic L-zeolite with a platinum group metal component on a refractory inorganic oxide binder and a platinum component and a tin component on a refractory support at conditions to limit the total production of coke in said first reforming reaction zone and said at least one additional reforming reaction zone to less than 1.5 wt. % coke on said catalyst per 1000 SCFB of $H_2$ produced, said conditions including an initial temperature of from 950°-1050° F., a pressure in a range of from 25 to 150 psig, an LHSV of from 2 to 10 and an initial molar $H_2$/HC of less than 2 to further convert said at least partially converted feed and produce additional hydrogen;

c) recovering a product stream comprising converted feed hydrocarbons and hydrogen from the last of the at least one additional reforming reaction zones; and, d) at least semicontinuously withdrawing coke containing reforming catalyst from and adding reforming catalyst having a reduced concentration of coke to said reforming reaction zones while contacting the feed with the reforming catalyst.

2. The process of claim 1 wherein the conditions in the reforming reaction zones include an initial temperature of 970°-1020° F., an LHSV of 2.5 to 5, and a pressure of 50 to 95 psig.

3. The process of claim 1 wherein said intermediate feed stream passes through one additional reforming reaction zone.

4. The process of claim 1 wherein the feed stream comprises a naphtha having a boiling point in a range of from 220°-350° F.

5. The process of claim 1 wherein said feed stream has undergone prefractionation to remove benzene.

6. A continuous reforming process for contacting a feed, containing hydrocarbons, with a reforming catalyst said process comprising:

a) heating said feed to a temperature in a range of from 950°-1050° F. and contacting said feed with a reforming catalyst comprising non-acidic L-zeolite and a platinum-group metal component on a refractory inorganic oxide binder in a first reforming reaction zone at a pressure in a range of from 25 to 150 psig, an LHSV of from 2 to 10 and an initial molar $H_2$/HC ratio of less than 2 to at least partially convert said feed and produce hydrogen;

b) recovering at least partially converted feed and hydrogen from said first reforming zone in an intermediate feed stream and contacting said intermediate feed stream in a second reforming reaction zone with a reforming catalyst comprising non-acidic L-zeolite and a platinum-group metal component on a refractory inorganic oxide binder at conditions to limit the total production of coke in said first reforming reaction zone and said second reforming zone to less than 1.5 wt. % coke on said catalyst per 1000 SCFB of $H_2$ produced said conditions including an initial temperature of from 950°-1050° F., a pressure in a range of from 25 to 150 psig, an LHSV of from 2 to 10 and an initial molar $H_2$/HC ratio of less than 2 to further convert said at least partially converted and produce additional hydrogen;

c) recovering a product stream comprising converted feed hydrocarbons and hydrogen from said second reforming reaction zone; and, d) at least semi-continuously withdrawing coke containing reforming catalyst from said second reforming reaction zone, passing coke containing reforming catalyst from said first reforming reaction zone to said second reforming reaction zone and at least semi-continuously adding fresh or regenerated reforming catalyst to said first reforming reaction zone.

7. The process of claim 1 wherein said LHSV is at least 5.

8. The process of claim 1 wherein said $H_2$/HC ratio is from 2 to 1.0.

* * * * *